US005630526A

United States Patent [19]

Moody

[11] Patent Number: 5,630,526

[45] Date of Patent: May 20, 1997

[54] SHEET MATERIAL DISPENSING SYSTEM

[75] Inventor: John R. Moody, Antioch, Calif.

[73] Assignee: James River Corporation of Virginia, Richmond, Va.

[21] Appl. No.: 550,931

[22] Filed: Oct. 31, 1995

[51] Int. Cl.[6] ..... A47K 10/24

[52] U.S. Cl. ..... 221/45; 225/106

[58] Field of Search ..... 221/33, 45, 63, 221/1; 225/106, 93; 242/564.4, 565

[56] References Cited

U.S. PATENT DOCUMENTS

| | | | |
|---|---|---|---|
| D. 306,384 | 3/1990 | Morand | D6/523 |
| D. 324,618 | 3/1992 | Morand | D6/523 |
| D. 324,969 | 3/1992 | Morand | D6/523 |
| D. 325,142 | 4/1992 | Morand | D6/523 |
| D. 340,822 | 11/1993 | Morand | D6/518 |
| D. 342,407 | 12/1993 | Morand | D6/516 |
| D. 347,135 | 5/1994 | Morand | D6/518 |
| D. 356,707 | 3/1995 | Morand | D6/522 |
| D. 357,150 | 4/1995 | Morand | D6/520 |
| 2,806,591 | 9/1957 | Appleton | 206/58 |
| 3,291,354 | 12/1966 | Ziebarth | 225/79 |
| 3,770,172 | 11/1973 | Nystrand et al. | 225/2 |
| 4,199,090 | 4/1980 | Reed | 225/13 |
| 4,520,968 | 6/1985 | Shipigelman | 242/55.3 |
| 4,522,346 | 6/1985 | Jespersen | 242/55.3 |
| 4,659,028 | 4/1987 | Wren | 242/55.53 |
| 4,846,412 | 7/1989 | Morand | 242/55.3 |
| 5,009,313 | 4/1991 | Morand | 206/391 |
| 5,058,792 | 10/1991 | Morand | 225/42 |
| 5,100,075 | 3/1992 | Morand | 242/55.2 |
| 5,131,903 | 7/1992 | Levine et al. | 493/464 |
| 5,135,179 | 8/1992 | Morano | 242/55.54 |
| 5,205,454 | 4/1993 | Schutz et al. | 225/1 |
| 5,211,308 | 5/1993 | Decker et al. | 221/63 |
| 5,215,211 | 6/1993 | Eberle | 221/1 |
| 5,219,092 | 6/1993 | Morand | 221/53 |
| 5,318,210 | 6/1994 | Morand | 225/43 |
| 5,335,811 | 8/1994 | Morand | 221/45 |

FOREIGN PATENT DOCUMENTS

| | | |
|---|---|---|
| 1325923 | 8/1973 | United Kingdom . |

*Primary Examiner*—Kenneth Noland
*Attorney, Agent, or Firm*—Thomas R. Lampe

[57] ABSTRACT

A system for dispensing individual sheet material segments from a roll of sheet material in which the sheet material is separated into individual segments by perforated tear lines. The sheet material roll is continually positioned on support rollers with the lead end of the sheet material passing through a nip defined by the rollers and a member which is biased against the rollers to resist rotation thereof. After passing through the nip the end of the toweling proceeds through a restricted opening. Pulling of the end-most segment by a consumer causes the end-most segment to be separated along the perforated tear line separating it from the adjoining, following segment.

14 Claims, 3 Drawing Sheets

SHEET MATERIAL DISPENSING SYSTEM

TECHNICAL FIELD

This invention relates to a system for dispensing individual sheet material segments from a roll of sheet material. The invention has particular application to the manual dispensing of individual paper towels from a roll of such towels separated by perforated tear lines.

BACKGROUND ART

Many dispenser devices exist or are known in the prior art for dispensing paper toweling. Quite often dispensing is from a roll of toweling, which may be either perforated or non-perforated, the dispenser operative to promote or cause tearing of individual towel segments from the roll.

U.S. Pat. No. 5,335,811, issued Aug. 9, 1994, discloses a dispenser for dispensing individual sheets of perforated paper toweling from a roll thereof. The dispenser includes a casing with a mounting for the roll in its upper portion and an outlet at the bottom. The outlet is substantially narrower than the width of the toweling. A roller is mounted in the casing for guiding the toweling from the roll mounting to the outlet.

The roller purportedly maintains the toweling at its full width. The toweling is gathered inwardly in passing from the roller to the outlet. According to the patent, upon pulling of the toweling out of the dispenser, the toweling begins to tear inwardly from its edges along the first line of perforations as the first line of perforations passes over the roller to separate a sheet from the remainder of the toweling. The tearing operation is completed outside the casing, leaving a tail end of toweling to be grasped during the next dispensing operation.

Other patents are in existence which disclose dispenser arrangements wherein paper toweling, tissue or similar products are dispensed from a roll and wherein individual segments are dispensed as a result of constricting the web material. Examples are: U.S. Pat. No. 4,659,028, issued Apr. 21, 1987, U.S. Pat. No. 2,806,591, issued Sep. 17, 1957, U.S. Pat. No. 5,131,903, issued U.S. Pat. No. Jul. 21, 1992, U.S. Pat. No. 5,211,308, issued May 18, 1993, and U.S. Pat. No. 5,215,211, issued Jun. 1, 1993.

The following patents are also considered representative of the state of the prior art: U.S. Pat. No. 4,522,346, issued Jun. 11, 1985, U.S. Pat. No. 4,520,968, issued Jun. 4, 1985, U.S. Pat. No. 3,291,354, issued Dec. 13, 1966, U.S. Pat. No. 5,318,210, issued Jun. 7, 1994, U.S. Pat. No. 5,219,092, issued Jun. 15, 1993, U.S. Pat. No. 5,135,179, issued Aug. 4, 1992, U.S. Pat. No. 5,100,075, issued Mar. 31, 1992, U.S. Pat. No. 5,058,792; issued Oct. 22, 1991, U.S. Pat. No. 4,846,412, issued Jul. 11, 1989, U.S. Pat. No. 5,205,454, issued Apr. 27, 1993, U.S. Pat. No. 5,009,313, issued Apr. 23, 1991, U.S. Pat. No. 3,770,172, issued Nov. 6, 1973, U.S. Pat. No. 4,199,090, issued Apr. 22, 1980, U.S. Pat. No. Design 357,150, issued Apr. 11, 1995, U.S. Pat. No. Design 356,707, issued Mar. 28, 1995, U.S. Pat. No. Design 347,135, issued May 24, 1994, U.S. Pat. No. Design 342,407, issued Dec. 21, 1993, U.S. Pat. No. Design 340,822, issued Nov. 2, 1993, U.S. Pat. No. Design 325,142, issued Apr. 7, 1992, U.S. Pat. No. Design 324,969, issued Mar. 31, 1992, U.S. Pat. No. Design 324,618, issued Mar. 17, 1992, and U.S. Pat. No. Design 306,384, issued Mar. 6, 1990. U.K. Pat. Specification No. 1,325,923, published Aug. 8, 1973, discloses a device for dispensing thin, flexible plastic film articles from a length of the articles detachably connected together at lines of weakness.

DISCLOSURE OF INVENTION

The system of the present invention relates to an improved and highly reliable approach for dispensing individual segments of sheet material from a roll thereof. The invention has particular application to the dispensing of individual paper towels from a roll of paper toweling having a plurality of perforated tear lines dividing the paper toweling into a plurality of individual towel segments. The invention is characterized not only by its high reliability but also by its simplicity and relatively low cost of manufacture.

The system of the invention includes a housing defining an interior and a sheet material dispensing opening in communication with the interior.

A roll of sheet material is accommodated within the interior. The roll of sheet material has a terminal end and side edges, the sheet material additionally having a plurality of perforated tear lines dividing the sheet material into a plurality of sheet material segments including an end-most segment partially defined by the terminal end.

The roll has an axis of rotation and the perforated tear lines are parallel to each other and extend across the sheet material between the side edges.

The sheet material dispensing opening of the housing receives the end-most segment of the roll of sheet material. The sheet material dispensing opening has a width less than the distance between the side edges of the roll of sheet material whereby the edges of the end-most segment of the roll of sheet material are engaged and move toward one another by the housing at opposed ends of the sheet material dispensing opening. The end-most segment is constricted when the end-most segment is received by and projects from the sheet material dispensing opening.

The apparatus also includes roll support rollers rotatably mounted on the housing at spaced locations on the housing adjacent to the sheet material dispensing opening. The roll support rollers rotatably support the roll of sheet material for rotation of the roll about the axis of rotation thereof when a pulling force is exerted by a user on the end-most segment projecting from the sheet material dispensing opening. The roll support rollers are cooperable with the roll of sheet material to terminate rotation thereof after separation of the end-most segment from the remainder of the roll of sheet material.

Nip defining means cooperates with the roll support rollers to form nips positioned between the roll of sheet material and the sheet material dispensing opening to exert drag forces on the roll support rollers and on sheet material being unwound from the roll of the sheet material and passing through the nips when a pulling force is exerted by a user on the endmost segment projecting from the sheet material dispersing opening.

Other features, advantages, and objects of the present invention will become apparent with reference to the following description and accompanying drawings.

BEST MODE FOR CARRYING OUT THE INVENTION

Figure 2:
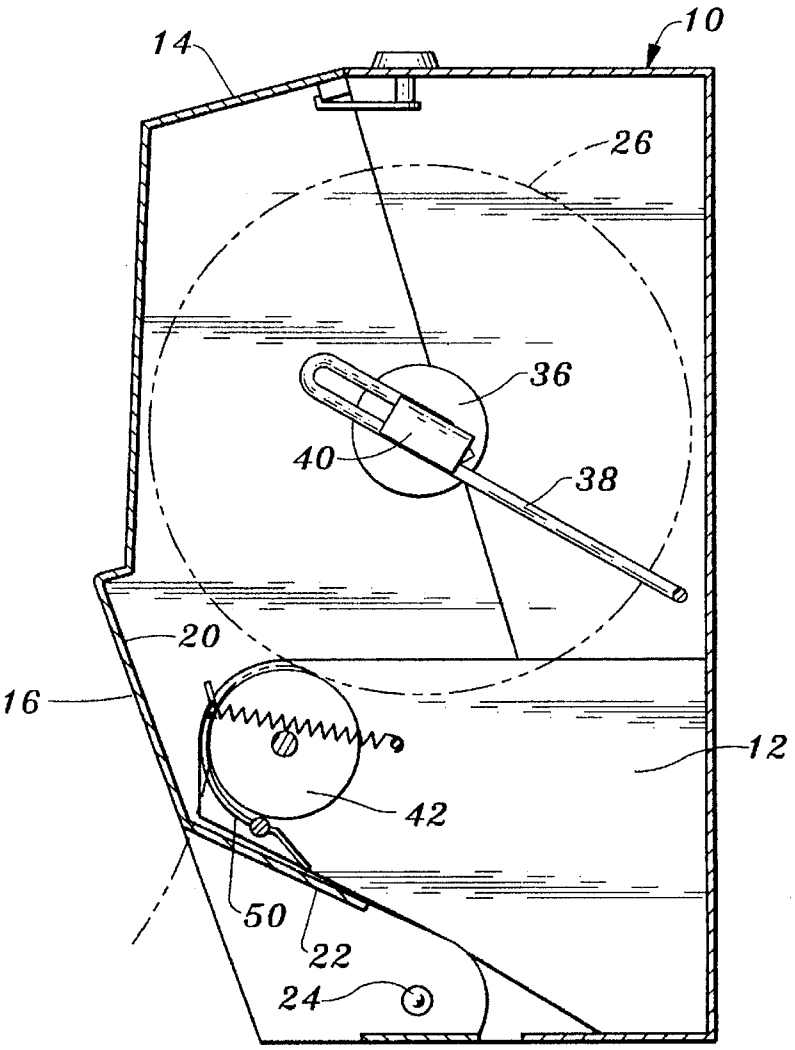
FIG. 2 is a cross-sectional view taken along line 2—2 of FIG. 1.

Referring now to the drawings, apparatus constructed in accordance with the teachings of the present invention includes a housing 10 defining an interior 12. The housing includes a cover 14 having a front wall 16.

Front wall 16 has a sheet material dispensing opening 18 formed therein. More particularly, front wall 16 includes a primary panel 20 defining the top of the opening and two secondary panels 22 integral with the primary panel and projecting inwardly therefrom, the secondary panels partially defining the opposed ends of the opening.

Figure 1:
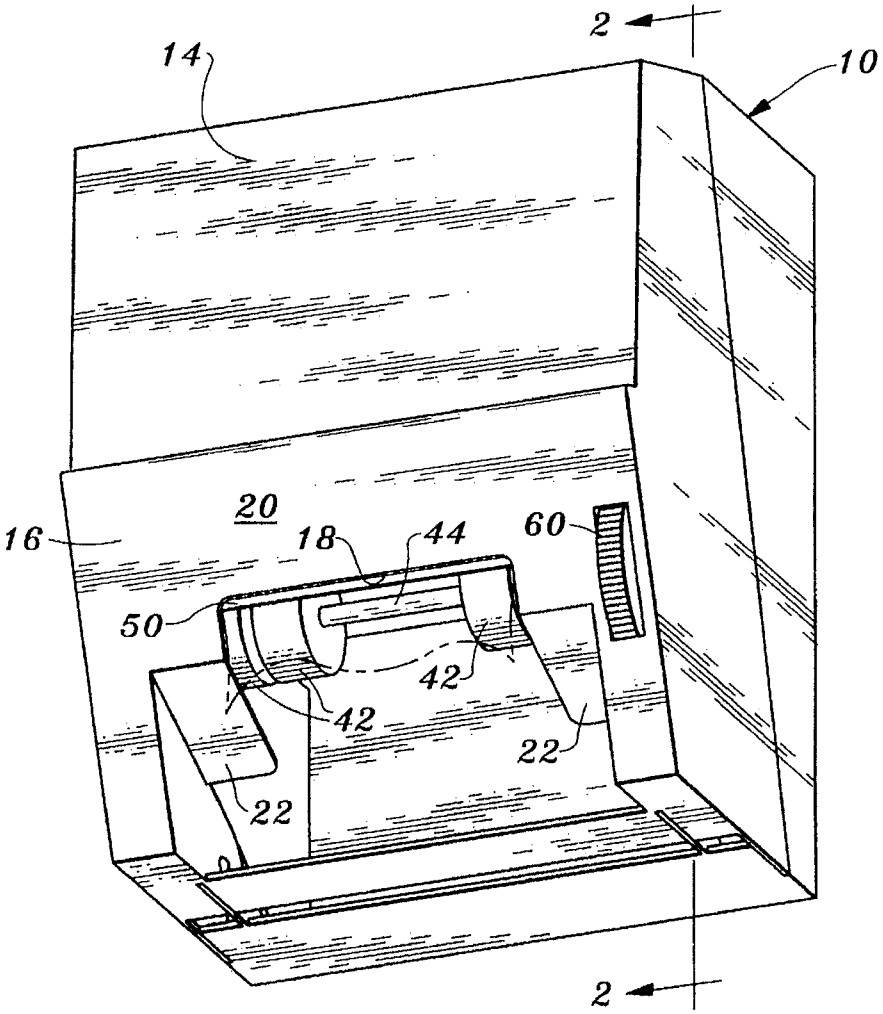
FIG. 1 is a frontal perspective view of a paper towel dispenser constructed in accordance with the teachings of the present invention illustrating in phantom the end-most paper towel segment projecting from the interior thereof.
Figure 3:
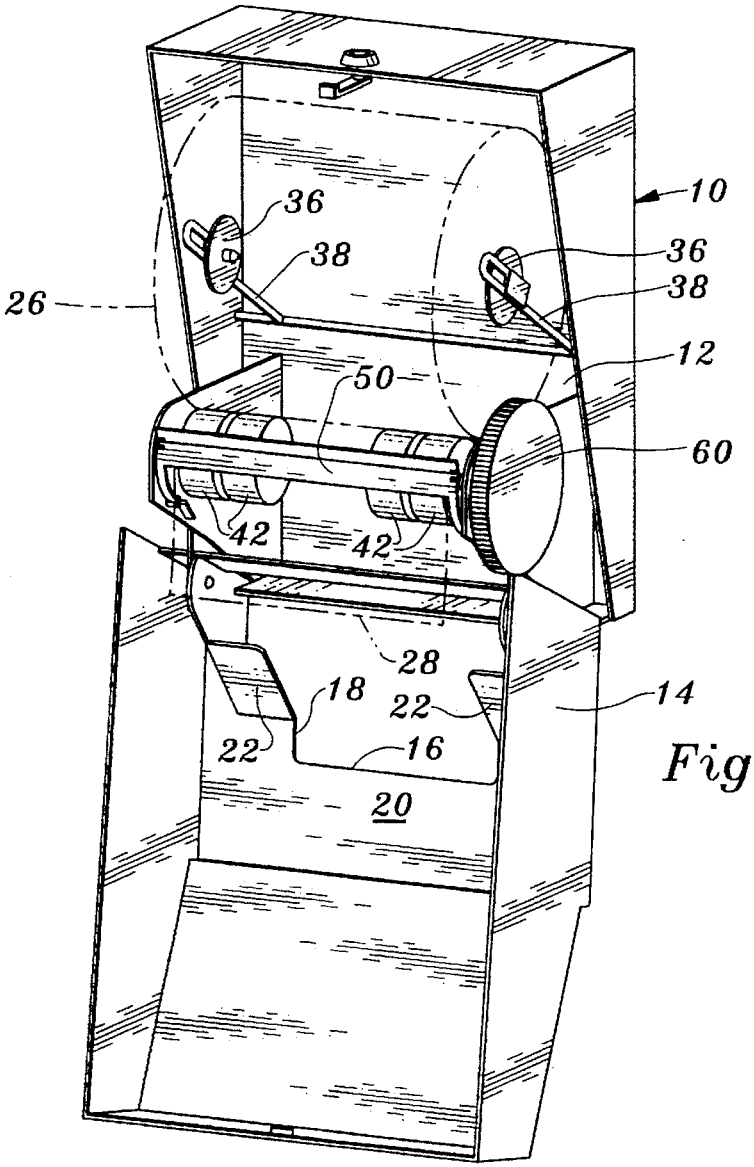
FIG. 3 is a frontal perspective view of the dispenser apparatus with the front cover thereof swung open to reveal the interior of the housing.
Figure 4:
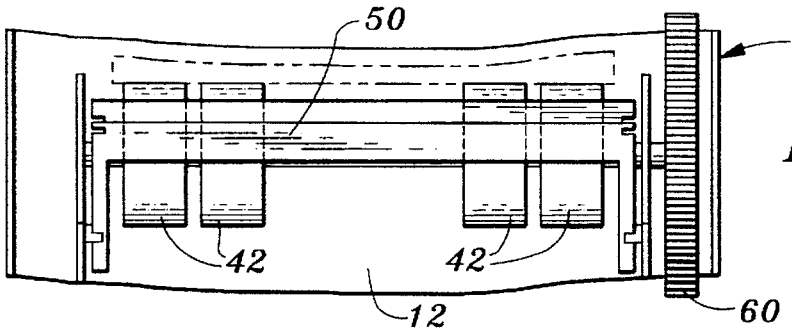
FIG. 4 is a partial front elevation view illustrating selected components of the dispenser apparatus including roll support rollers and a curved plate for forming nips with the roll support rollers.

The cover 14 is hingedly attached to the remainder of the housing at pivot 24 so that the cover can be moved between its open position shown in FIG. 3 to the closed position shown in FIGS. 1 and 2, for example. A suitable conventional latch mechanism 26 is utilized to selectively secure the cover in closed position.

Figure 5:
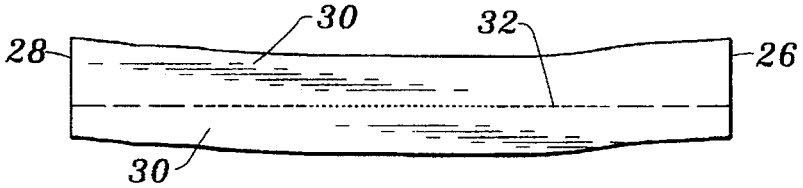
FIG. 5 is a partial plan view illustrating a portion of a paper towel roll, specifically two adjoining paper towel segments separated by a perforated tear line defined by spaced perforations of differing lengths.

Interior 12 of the housing accommodates therein a roll 26 comprised of convolutions of paper toweling 28. As is conventional, the web of paper toweling 28 has a terminal end and parallel side edges. The toweling additionally has a plurality of perforated tear lines dividing the toweling into a plurality of sheet material segments. FIG. 5 illustrates two adjacent segments 30 interconnected along a perforated tear line 32, it being understood that there are many such perforated tear lines in the complete web of toweling to divide the web into numerous towel segments. An end-most toweling segment is partially defined by the terminal end and is shown in FIGS. 1, 2, 6 and 7 projecting through opening 18.

The roll 26 is freely rotatably mounted within the interior of the housing on trunnions 36 projecting into the ends of the roll. The trunnions themselves are mounted on pivoting arms 38 pivotally secured to the housing. In the arrangement illustrated the arms 38 are doubled over at the distal ends thereof and retain thereon a bracket 40 to which each of the trunnions is rotatably secured. If desired, each bracket 40 can be constructed so as to be manually adjustable relative to its associated arm to adjust the positioning of the rotatably mounted roll relative to the arm.

The apparatus also includes freely rotatable roll support rollers 42 disposed on a common shaft 44 extending between the sides of the housing.

It is important to note that the roll 26 always rests on and is supported by the rollers 42, and rotation of the rollers will rotate the roll and rotation of the roll will rotate the rollers. The arms 38 are freely pivotally movable relative to the housing to ensure constant contact between the roll and the support rollers.

In the arrangement illustrated, there are four rollers 42. This number can vary, however. It is important that at least one roller be located at each end of the shaft and engageable by the roll. The rollers at one end of the shaft are spaced from the rollers at the other end of the shaft so that a gap is formed therebetween. At least some of the roll support rollers are in partial registry with the sheet material dispensing opening.

The apparatus includes nip defining means cooperating with the roll support rollers to form nips positioned between the roll 26 and the opening 18 to exert drag forces on the rollers and on sheet material being unwound from the roll and passing 5 through the nips when a pulling force is exerted by a user on the end-most towel segment projecting from the sheet material dispensing opening.

The nip defining means is in the form of a curved plate 50 which is located between the rollers and the opening 18. Curved plate 50 preferably has a curvature conforming to the outer peripheral curvatures of the rollers. Curved plate 50 is pivotally attached to the housing 10 on pivots 52 located at the side walls of the housing. A coil spring 54 connected between the curved plate 50 and the housing continuously biases the curved plate toward the rollers so that nips are defined therebetween.

After a roll 26 has been rotatably mounted within the housing interior, the lead end thereof is passed between the curved plate 50 and the rollers and then outwardly through opening 18. The cooperating curved plate 50 and rollers will exert forces on the toweling passing through the nips formed thereby which will resist outward pulling of the paper toweling by a consumer.

Opening 18 has a width less than the distance between the side edges of the roll 26. The edges of the end-most segment of the roll are engaged and moved toward one another by the housing at opposed ends of the opening to constrict the end-most segment when the end-most segment is received by and projects from the sheet material dispensing opening.

Figure 6:
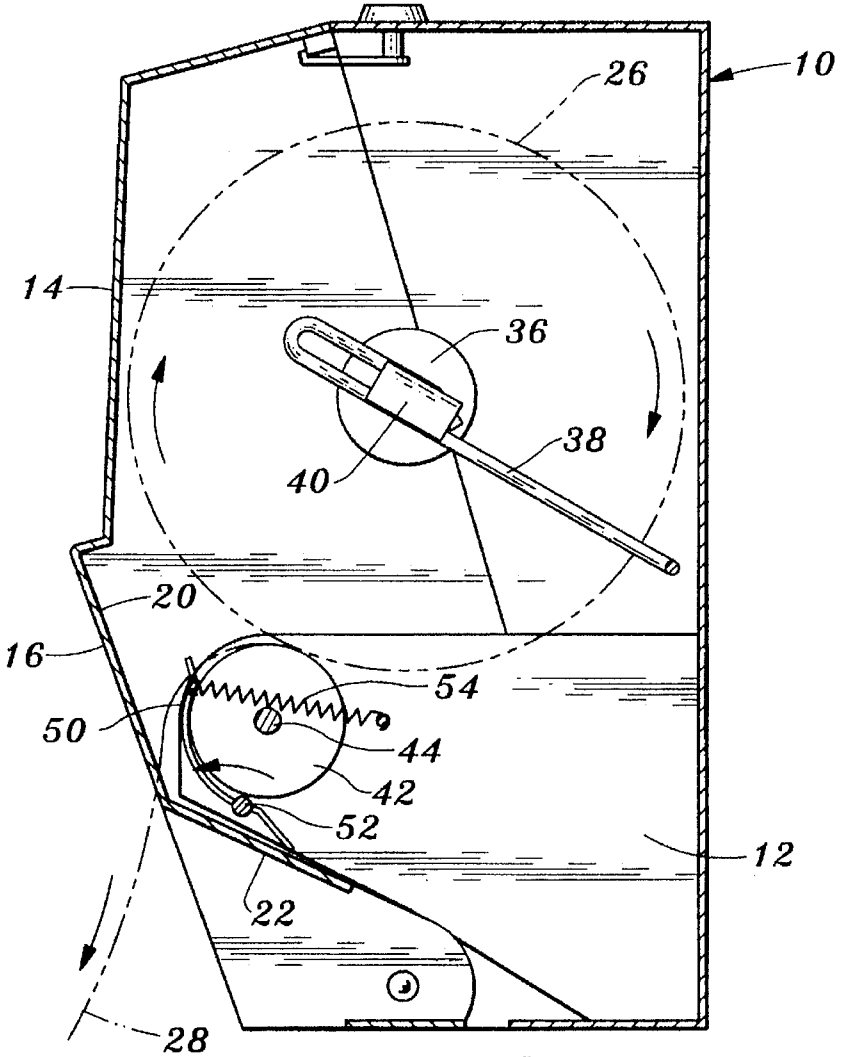
FIG. 6 is a view similar to FIG. 2 but illustrating the relative positions assumed by structural elements of the apparatus during dispensing from the roll of paper toweling.

To remove the end-most segment from the web of paper toweling, the consumer pulls on the end-most segment from a location external of the housing. This causes rotation of roll 26 (as shown in FIG. 6 for example) as well as rotation of the roll support rollers 42. The biased curved plate 50 will resist such pulling action and tensional forces will be established in the paper toweling between the roll and the point of application of pulling forces by the consumer.

When the perforated tear line dividing the end-most toweling segment from its adjacent, following segment reaches the vicinity of opening 18, the paper toweling will start separating at the perforated tear line, usually first at the edges. Continued pulling of the end-most segment will result in complete separation of the end-most segment and present the adjacent, following toweling segment in position so that it projects from the opening and is presented for grasping by a subsequent consumer. This separating action can be facilitated by employing spaced perforations which are closer together near the side edges of the sheet material than in the middle thereof. This arrangement is shown in FIG. 5 and will encourage separation from the edges inwardly.

The gap or space between the rollers at the center of the apparatus facilitates manual access by a consumer to the toweling. Preferably the apparatus includes a knob 60 which projects outwardly of the cabinet. Through any suitable conventional one-way clutching mechanism (not shown) the knob 60 can be rotated and utilized by a consumer to rotate rollers 42 and thus roll 26 to feed the end-most segment outwardly, for example, when and if the end-most segment breaks from the rest of the toweling web prematurely and does not provide for projection of the following segment through the opening.

A very important aspect of the present invention resides in the fact that the structural elements of the apparatus cooperate to prevent free wheeling of the roll 26 due to dispensing of the end-most segment. Such free wheeling could cause the mechanism of the apparatus to be jammed by excess toweling unwound from the roll.

Figure 7:
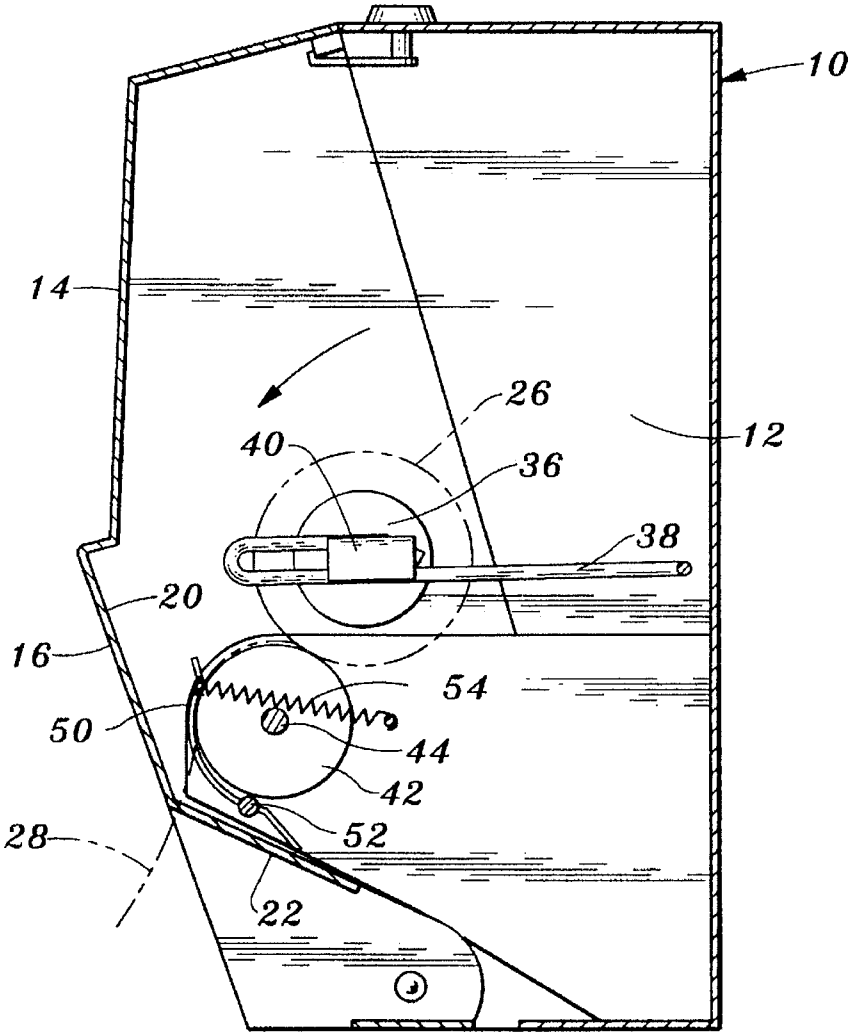
FIG. 7 is a sectional view similar to FIG. 2 but illustrating a substantially depleted roll of paper toweling supported by the roll support rollers of the apparatus.

Such free wheeling is prevented due to the fact that there is constant engagement between the roll support rollers 42 and the roll 26 even when the roll is substantially depleted as shown in FIG. 7. The curved plate 50 acts as a braking mechanism for the rollers 42 so that they will cease rotating as soon as any pulling force on the toweling is terminated. This in turn will immediately stop rotation of the supply roll 26 due to the frictional engagement between the roll and the rollers.

With the present invention towel dispensing can readily be accomplished by the consumer pulling the end-most towel segment in his or her direction. However, dispensing is also readily accomplished by pulling the end-most segment downwardly. Dispensing will occur in a reliable fashion either way. To at least some extent this is a result of the fact that the configurations of the primary panel 20 and secondary panels 22 define an opening for egress of the paper toweling oriented both toward the front and downwardly relative to the housing. It is to be noted that the secondary panels 22 pass under the rollers 42 to some degree so that it is impossible to pull a towel other than through the restricted opening.

I claim:

1. Apparatus for dispensing sheet material from a roll of sheet material, said apparatus comprising, in combination:

a housing defining an interior for accommodating a roll of sheet material having a terminal end and side edges, said sheet material additionally having a plurality of perforated tear lines dividing said sheet material into a plurality of sheet material segments including an end-most segment partially defined by said terminal end, said roll having an axis of rotation and said perforated tear lines being parallel to each other and extending across the sheet material between said side edges, and said housing additionally defining a sheet material dispensing opening in communication with said interior for receiving the end-most segment of said roll of sheet material, said sheet material dispensing opening having a width less than the distance between the side edges of said roll of sheet material whereby the edges of the end-most segment of said roll of sheet material are engaged and moved toward one another by said housing at opposed ends of said sheet material dispenser opening to constrict said end-most segment when the end-most segment is received by and projects from said sheet material dispensing opening;

roll support rollers rotatably mounted on said housing at spaced locations on said housing adjacent to said sheet material dispensing opening for rotatably supporting said roll of sheet material for rotation of the roll of sheet material about the axis of rotation thereof when a pulling force is exerted by a user on the end-most segment projecting from said sheet material dispensing opening and cooperable with said roll of sheet material to terminate rotation thereof after separation of the end-most segment from the remainder of the roll of sheet material; and nip defining means cooperating with said roll support rollers to form nips positioned between said roll of sheet material and said sheet material dispensing opening to exert drag forces on said roll support rollers and on sheet material being unwound from said roll of sheet material and passing through said nips when a pulling force is exerted by a user on the end-most segment projecting from said sheet material dispensing opening.

2. The apparatus according to claim 1 wherein said nip defining means includes at least one curved member curving partially about said roll support rollers.

3. The apparatus according to claim 2 additionally comprising biasing means yieldably biasing said at least one curved member toward said roll support rollers.

4. The apparatus according to claim 2 wherein said at least one curved member comprises a curved plate having a curvature substantially conforming to the outer peripheral curvatures of said roll support rollers and pivotally interconnected to said housing.

5. The apparatus according to claim 4 wherein said curved plate is positioned within the interior of the housing between said roll support rollers and said sheet material dispensing opening.

6. The apparatus according to claim 1 wherein said roll support rollers are rotatably mounted on said housing within said housing interior at locations spaced from each other and are located at the opposed ends of said sheet material dispensing opening.

7. The apparatus according to claim 6 wherein said roll support rollers are in partial registry with said sheet material dispensing opening.

8. The apparatus according to claim 1 wherein said roll support rollers are disposed on a shaft for rotation relative to the housing, said apparatus additionally comprising a manually engageable element attached to said shaft and manually engageable from a position external of said housing to permit manual rotation of said shaft and said roll support rollers.

9. The apparatus according to claim 1 wherein said housing includes a front wall at least partially defining said sheet material dispensing opening.

10. The apparatus according to claim 9 wherein said front wall includes a primary panel defining the top of said sheet material dispensing opening and positioned in front of said roll support rollers and secondary panels attached to said primary panel and projecting inwardly from said primary panel, said secondary panels at least partially defining the opposed ends of said sheet material dispensing opening.

11. The apparatus according to claim 10 wherein said secondary panels extend downwardly from said primary panel and under said roll support rollers, said primary panel and said secondary panels defining the opposed ends of said sheet material dispensing opening.

12. A method of separating individual segments from a roll of sheet material having a terminal end and side edges, said sheet material additionally having a plurality of perforated tear lines dividing said sheet material into a plurality of sheet material segments including an end-most segment partially defined by said terminal end, said roll having an axis of rotation and said perforated tear lines being parallel to each other and extending across the sheet material between said side edges, said method comprising the steps of:

positioning said roll on roll support rollers;

supporting said roll on said roll support rollers;

while said roll is supported on said roll support rollers, applying a pulling force on said end-most segment to simultaneously rotate said roll about the axis of rotation thereof to unwind said roll and rotate said roll support rollers;

while applying said pulling force, passing said end-most segment through a restricted opening to constrict said end-most segment and exert forces on the side edges of said sheet material in opposition to said pulling force;

simultaneously with the steps of applying said pulling force and passing said end-most segment through a restricted opening, passing said sheet material through a nip at least partially defined by said roll support rollers;

at said nip, exerting a force on said roll support rollers resisting rotation of said roll support rollers and said roll; and utilizing all of said forces to separate the end-most segment from the remainder of said sheet material along the perforated tear line separating the end-most segment from the remainder of said sheet material.

13. In combination:

a roll of sheet material having a terminal end and side edges, said sheet material additionally having a plurality of perforated tear lines dividing said sheet material into a plurality of sheet material segments including an end-most segment partially defined by said terminal end, said roll having an axis of rotation and said perforated tear lines being parallel to each other and extending across the sheet material between said side edges;

a housing defining an interior accommodating said roll of sheet material and a sheet material dispensing opening in communication with said interior receiving the end-most segment of said roll of sheet material, said sheet material dispensing opening having a width less than the distance between the side edges of said roll of sheet material whereby the edges of the end-most segment of said roll of sheet material are engaged and moved toward one another by said housing at opposed ends of said sheet material dispensing opening to constrict said end-most segment when the end-most segment is received by and projects from said sheet material dispensing opening;

roll support rollers rotatably mounted on said housing at spaced locations on said housing adjacent to said sheet material dispensing opening rotatably supporting said roll of sheet material for rotation of the roll of sheet material about the axis of rotation thereof when a pulling force is exerted by a user on the end-most segment projecting from said sheet material dispensing opening and cooperable with said roll of sheet material to terminate rotation thereof after separation of the end-most segment from the remainder of the roll of sheet material; and nip defining means cooperating with said roll support rollers to form nips positioned between said roll of sheet material and said sheet material dispensing opening to exert drag forces on said roll support rollers and on sheet material being unwound from said roll of sheet material and passing through said nips when a pulling force is exerted by a user on the end-most segment projecting from said sheet material dispensing opening.

14. The combination according to claim 13 wherein the perforated tear lines are defined by perforations, the perforations near the side edges of the sheet material being closer together than the perforations in the middle of the sheet material.

* * * * *